US009429007B2

(12) United States Patent
Reitsma et al.

(10) Patent No.: US 9,429,007 B2
(45) Date of Patent: Aug. 30, 2016

(54) MANAGED PRESSURE DRILLING WITH RIG HEAVE COMPENSATION

(75) Inventors: Donald G. Reitsma, Katy, TX (US); Ossama R. Sehsah, Katy, TX (US); Yawan Couturier, Katy, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 430 days.

(21) Appl. No.: 13/428,935

(22) Filed: Mar. 23, 2012

(65) Prior Publication Data

US 2012/0241163 A1 Sep. 27, 2012

Related U.S. Application Data

(60) Provisional application No. 61/467,220, filed on Mar. 24, 2011, provisional application No. 61/479,889, filed on Apr. 28, 2011.

(51) Int. Cl.

| | |
|---|---|
| ***E21B 7/12*** | (2006.01) |
| ***E21B 44/00*** | (2006.01) |
| ***E21B 19/09*** | (2006.01) |
| ***E21B 21/08*** | (2006.01) |
| ***E21B 21/10*** | (2006.01) |

(52) U.S. Cl.

CPC ..... *E21B 44/00* (2013.01); *E21B 19/09* (2013.01); *E21B 21/08* (2013.01); *E21B 21/106* (2013.01)

(58) Field of Classification Search

CPC ..... E21B 7/12; E21B 19/006
USPC ..... 166/355, 358; 175/5, 7, 48
See application file for complete search history.

(56) References Cited

U.S. PATENT DOCUMENTS

| | | | | |
|---|---|---|---|---|
| 4,626,135 | A | 12/1986 | Roche | |
| 5,894,895 | A | 4/1999 | Welsh | |
| 6,904,981 | B2 | 6/2005 | van Riet | |
| 7,237,623 | B2 * | 7/2007 | Hannegan | 175/7 |
| 7,448,454 | B2 * | 11/2008 | Bourgoyne et al. | 175/7 |
| 7,478,555 | B2 * | 1/2009 | Zhan et al. | 73/152.55 |
| 7,699,109 | B2 * | 4/2010 | May et al. | 166/367 |
| 7,926,593 | B2 * | 4/2011 | Bailey et al. | 175/87 |
| 8,033,335 | B2 * | 10/2011 | Orbell et al. | 166/367 |
| 8,322,432 | B2 * | 12/2012 | Bailey et al. | 166/344 |
| 8,347,982 | B2 * | 1/2013 | Hannegan et al. | 175/5 |

(Continued)

OTHER PUBLICATIONS

Letter from Richard D. Fladung of Strasburger, representative for Weatherford, to counsel for Applicant; Dated Jul. 22, 2015 (3 pages).

*Primary Examiner* — Matthew Buck
*Assistant Examiner* — Aaron Lembo
(74) *Attorney, Agent, or Firm* — David J. Smith

(57) ABSTRACT

A method for maintaining pressure in a wellbore drilled from a drilling platform floating on a body of water includes pumping fluid at a determined flow rate into a drill string disposed in a wellbore and measuring fluid pressure within a fluid discharge line of fluid returning from the wellbore. The fluid discharge line has a variable length corresponding to an elevation of the floating platform above the bottom of the body of water. The wellbore pressure is determined at a selected depth in the wellbore or at a selected position along a drilling riser or variable length portion of the fluid discharge line using known parameters/methods. The determined wellbore pressure is adjusted for changes in length of the fluid discharge line corresponding to changes in the elevation of the floating platform relative to the bottom of the body of water.

19 Claims, 11 Drawing Sheets

(56) References Cited

U.S. PATENT DOCUMENTS

| | | | | |
|---|---|---|---|---|
| 8,347,983 | B2 * | 1/2013 | Hoyer et al. | 175/22 |
| 8,381,816 | B2 * | 2/2013 | Leduc et al. | 166/311 |
| 8,408,297 | B2 * | 4/2013 | Bailey et al. | 166/250.15 |
| 8,459,361 | B2 * | 6/2013 | Leuchtenberg | 166/355 |
| 8,517,111 | B2 * | 8/2013 | Mix et al. | 166/363 |
| 8,636,087 | B2 * | 1/2014 | Hannegan et al. | 175/40 |
| 8,640,778 | B2 * | 2/2014 | Fossli | 166/367 |
| 8,689,880 | B2 * | 4/2014 | Leuchtenberg | 166/355 |
| 8,701,796 | B2 * | 4/2014 | Bailey et al. | 175/87 |
| 2006/0037781 | A1 | 2/2006 | Leuchtenberg | |
| 2007/0045006 | A1 | 3/2007 | Krueger et al. | |

* cited by examiner

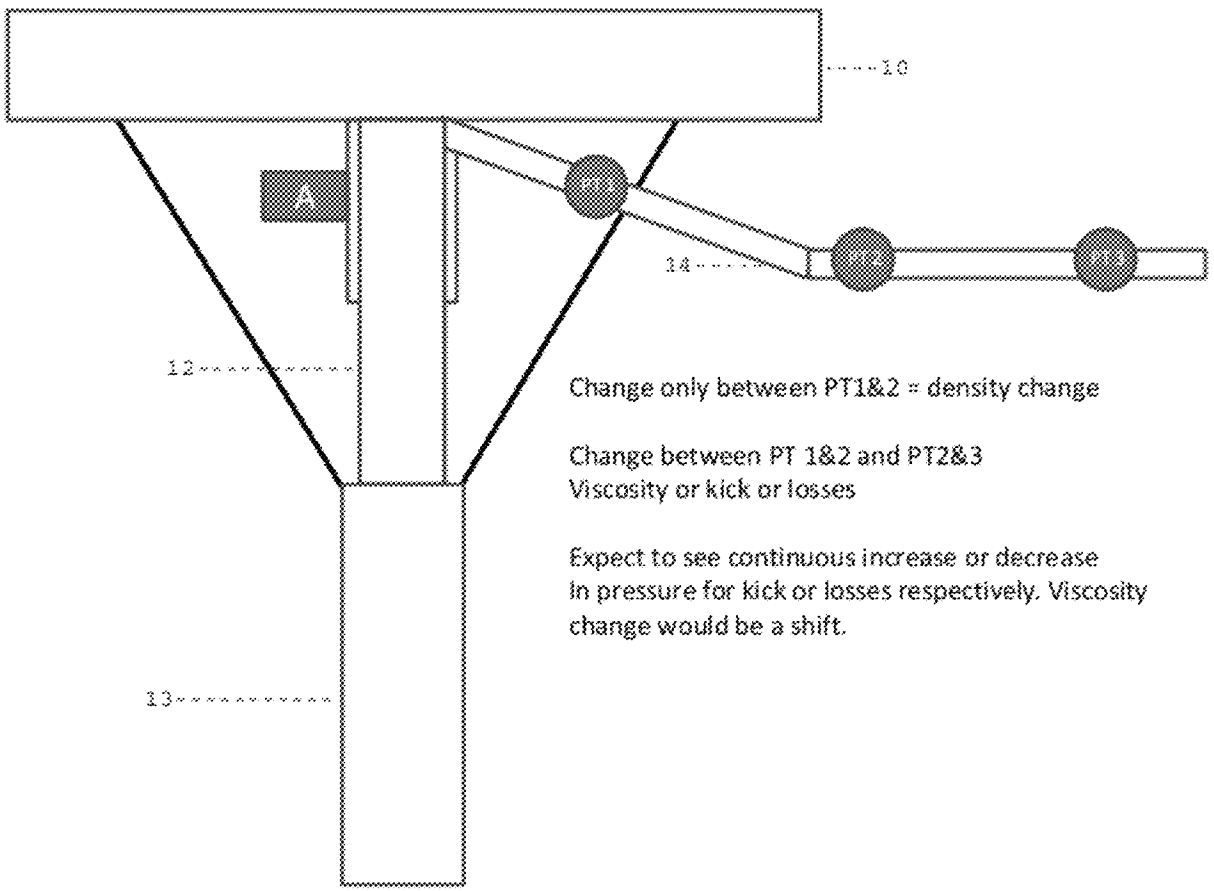
Figure 1: Pressure Sensors on discharge piping for kick detection

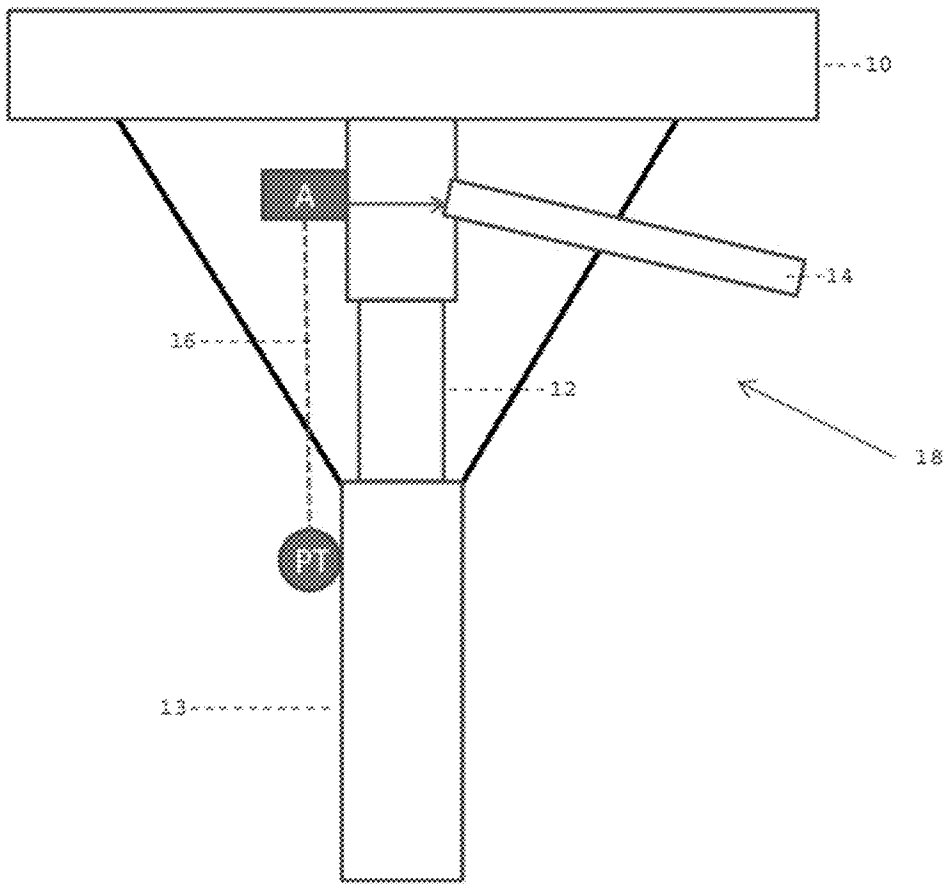
Figure 2a: Telescoping joint extended

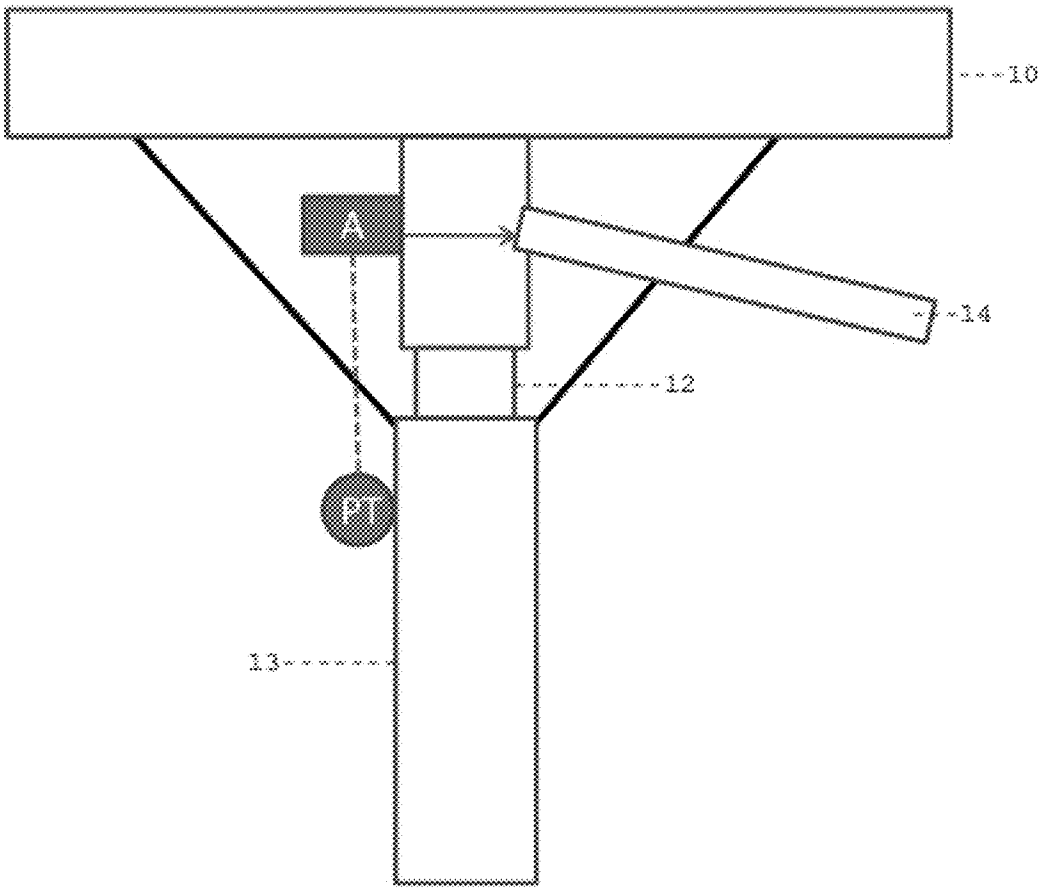
Figure 2b: Telescoping joint collapsed

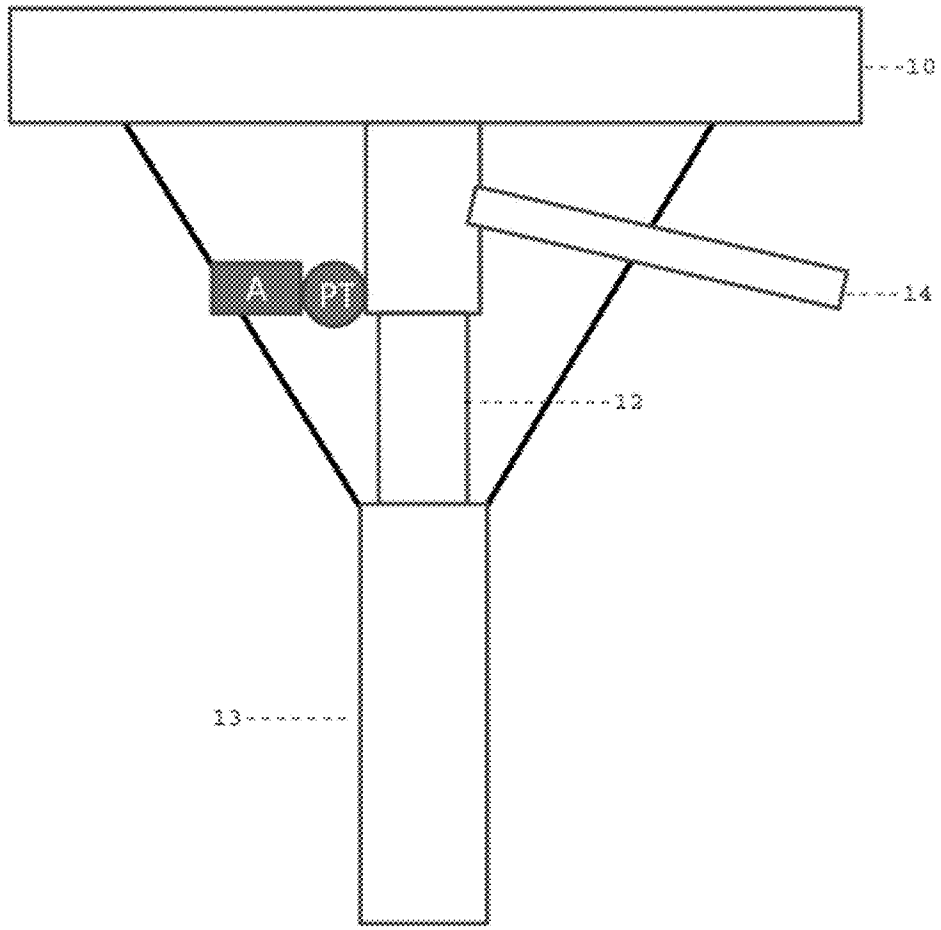
Figure 3a: Elevation measurement of outlet and pressure measurement

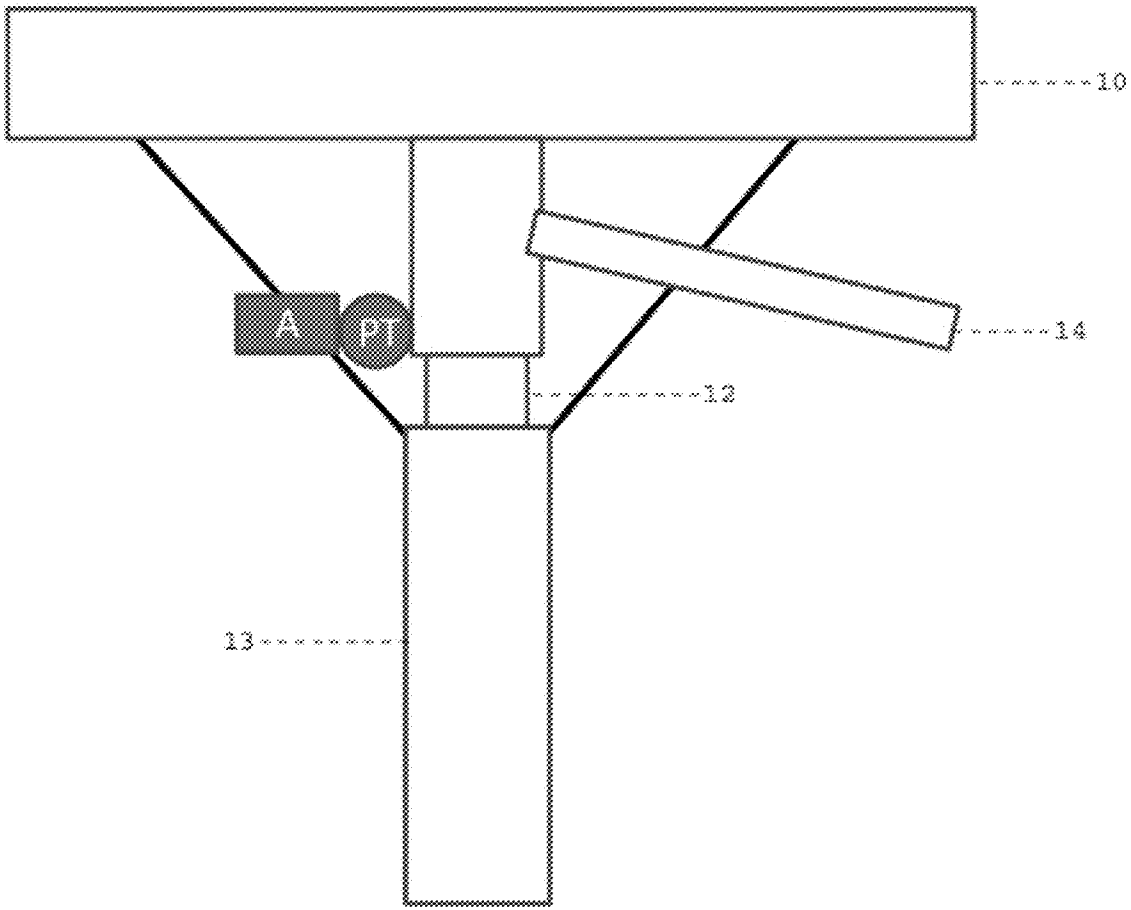
Figure 3b: Telescoping joint collapsed

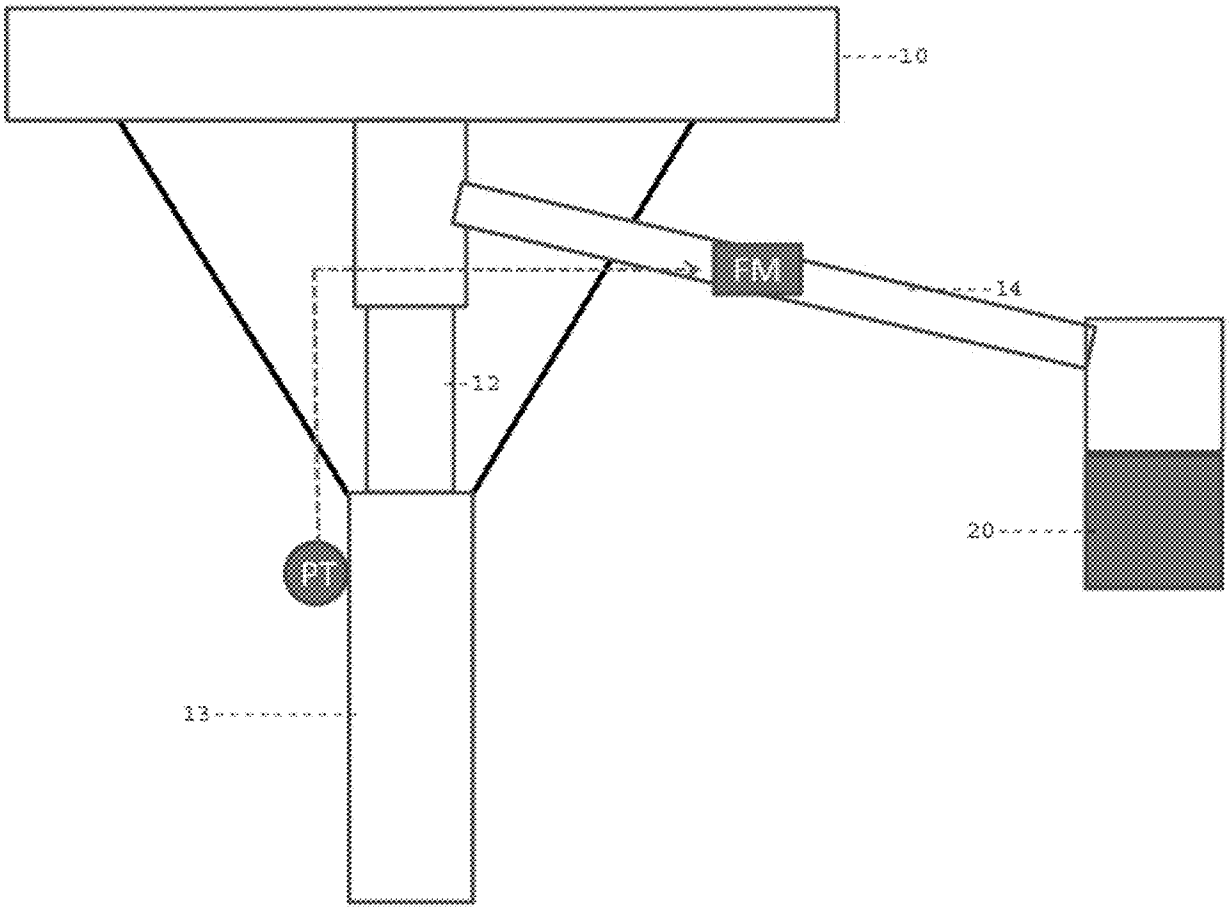
Figure 4a: Telescoping joint extended

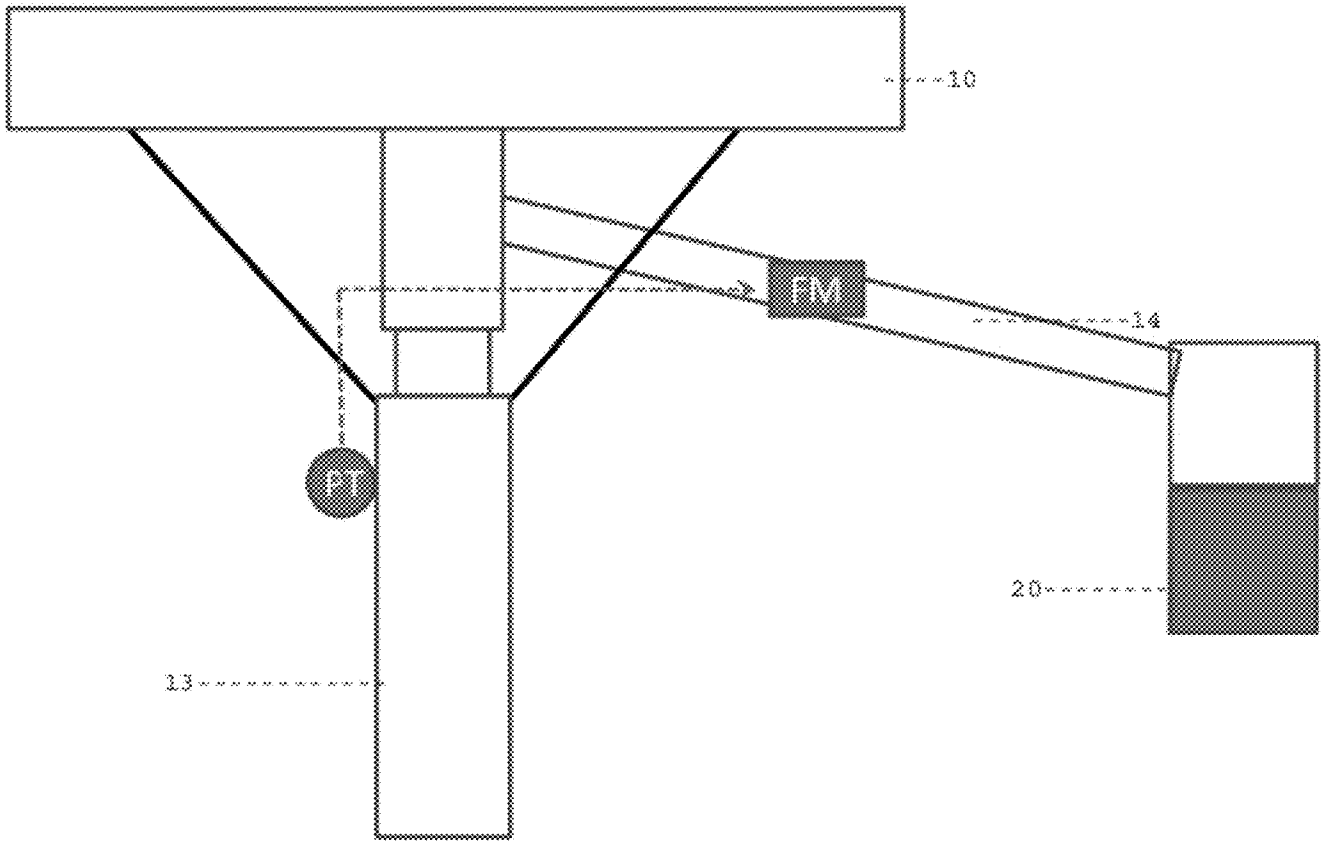
Figure 4b: Telescoping joint collapsed

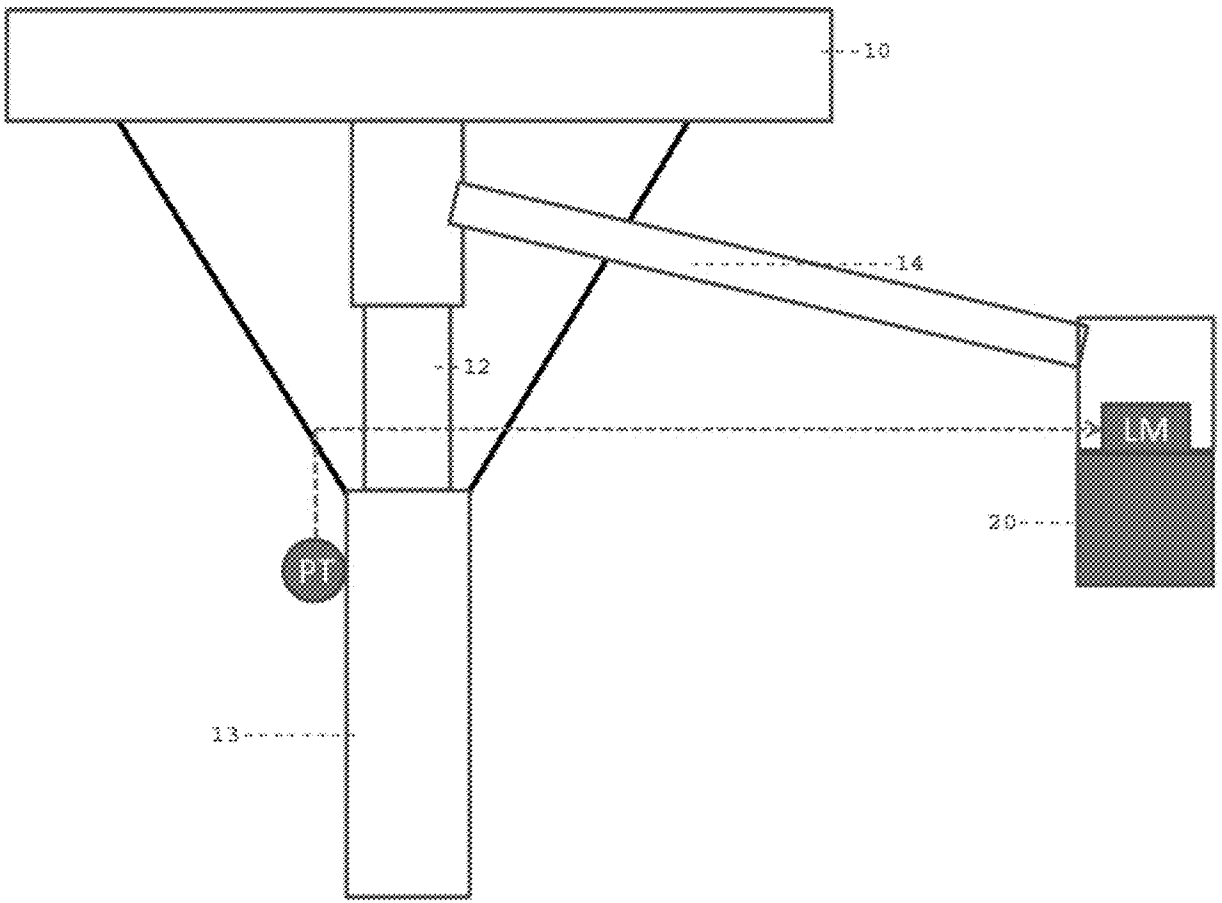
Continuous monitoring of pit level meter position
Figure 5a: Telescoping joint extended

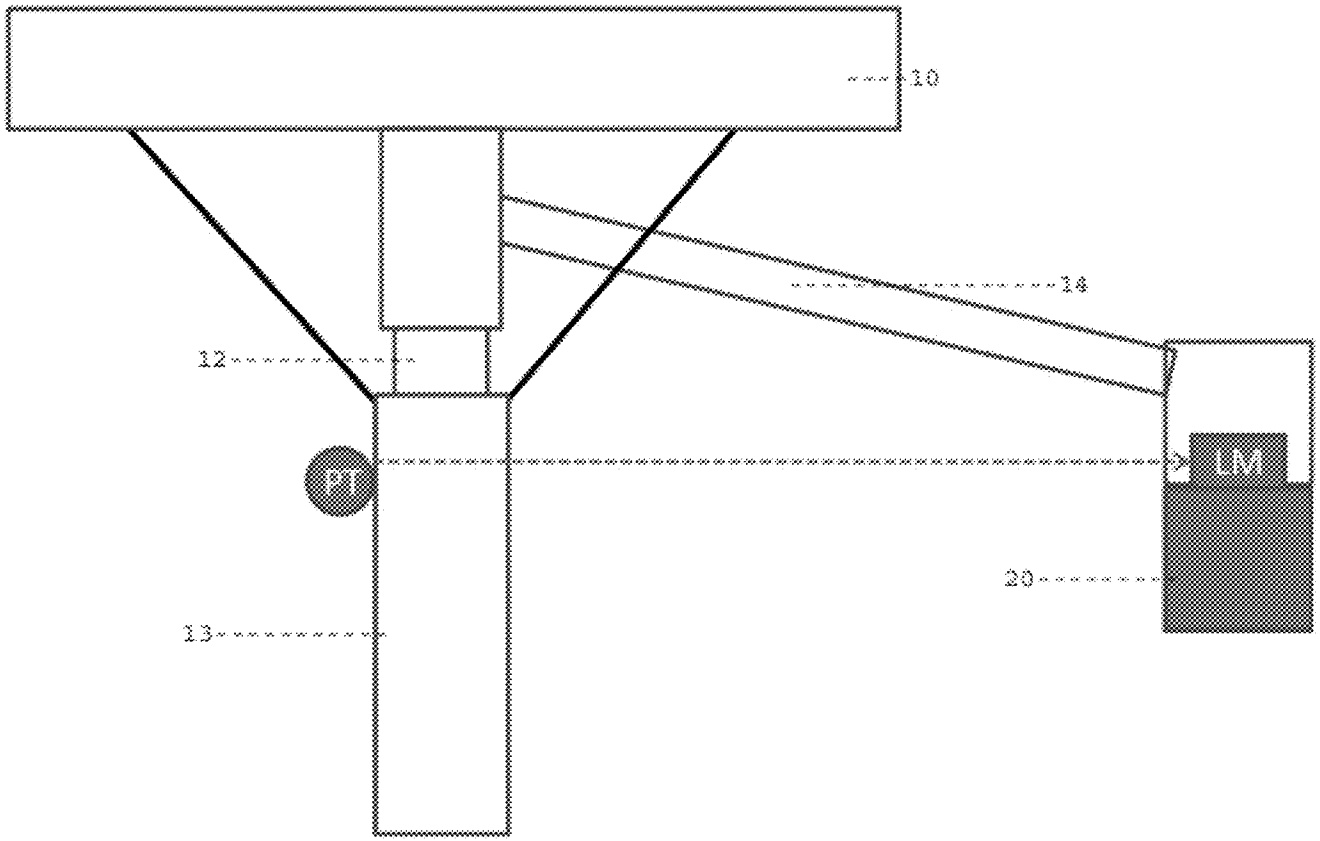
Figure 5b: Telescoping joint collapsed

MANAGED PRESSURE DRILLING WITH RIG HEAVE COMPENSATION

CROSS-REFERENCE TO RELATED APPLICATIONS

This application claims the benefit of U.S. Provisional Application No. 61/467,220, filed on Mar. 24, 2011, and U.S. Provisional Application No. 61/479,889, filed on Apr. 28, 2011, which are both incorporated herein by reference.

BACKGROUND

Managed pressure drilling in the most general sense is a process for drilling wellbores through subsurface rock formations in which wellbore fluid pressures are maintained at selected values while using drilling fluid that is less dense than that needed to produce a hydrostatic fluid pressure sufficient to prevent fluid entry into the wellbore from permeable rock formations as a result of naturally-occurring fluid pressure. Sufficient equivalent hydrostatic pressure to prevent fluid entry is provided in managed pressure drilling as a result of pumping drilling fluid at a selected rate through a drill string to increase its equivalent hydrostatic pressure in the wellbore, and by selectively controlling the rate of discharge of fluid from the wellbore annulus (the space between the wellbore wall and the exterior of the drill string). One such method and system are described in U.S. Pat. No. 6,904,981 issued to van Riet and commonly owned with the present disclosure. Generally, the system described in the van Riet '981 patent (called a "dynamic annular pressure control" or "DAPC" system) uses a rotating diverter or rotating control head to close the annular space between the drill string and the wellbore wall at the top of the wellbore. Fluid flow out of the wellbore is automatically controlled so that the fluid pressure gradient in the wellbore is maintained at a selected amount. That is, the actual fluid pressure at any selected vertical depth in the wellbore is controlled by the same process of selective pumping fluid into the wellbore and controlling discharge from the wellbore.

Certain types of marine drilling platforms float on the water surface, e.g., semisubmersible rigs and drill ships. Such drilling platforms are subject to a change in the elevation of the platform with respect to the bottom of the body of water in which a wellbore is being drilled due to wave and tide action. In order to maintain selected axial force on the drill bit during drilling operations, among other operations, it is necessary to adjust the elevation of the drilling equipment on the floating platform or corresponding operation. An example of a heave motion compensator is described in U.S. Pat. No. 5,894,895 issued to Welsh.

Heave motion compensation changes the effective length of both the drill string and the drilling fluid return line; therefore, managed pressure drilling systems, such as the one described in the van Riet '981 patent, may operate incorrectly on floating drilling platforms because the pressure measurements made by such managed pressure drilling systems infer the wellbore fluid pressure and fluid pressure gradient at any depth in the well from measurements of pressure made proximate the wellbore fluid outlet. Thus, a change in the length of the fluid return path along the wellbore will change the calculated wellbore annulus pressure.

In view of the foregoing, there is a need for a managed pressure drilling system operating method and arrangement that properly accounts for heave motion compensation on floating drilling platforms.

SUMMARY

A method for maintaining pressure in a wellbore drilled from a drilling platform floating on a body of water includes the steps of pumping fluid at a determined flow rate into a drill string disposed in a wellbore and measuring fluid pressure within a fluid discharge line of the fluid returning from the wellbore. The fluid discharge line has a variable length corresponding to an elevation of the floating platform above the bottom of the body of water. In another step, the wellbore pressure is determined at a selected depth in the wellbore or at a selected position along a drilling riser or variable length portion of the fluid discharge line using one or more of: the determined flow rate, the measured fluid pressure, a hydraulics model or the rheological properties of the fluid in the wellbore. The determined wellbore pressure is adjusted to account for changes in length of the fluid discharge line corresponding to changes in the elevation of the floating platform relative to the bottom of the body of water.

A backpressure system may be operated to maintain the adjusted determined wellbore pressure at a selected (or set point) value by applying backpressure to the wellbore. Steps for operating the backpressure system in one or more embodiments include measuring a fluid pressure in the wellbore proximate a blowout preventer and measuring a fluid pressure in the fluid discharge line at a position prior to a variable orifice restriction, i.e., a controllable orifice choke, disposed in the fluid discharge line. Time derivatives of measured fluid pressures in the wellbore proximate the blowout preventer and the fluid discharge line at the position prior to the variable orifice restriction are determined. The variable orifice restriction may then be controlled or operated, at least with respect to the time derivatives of the measured pressures, to apply the necessary backpressure to the wellbore, thereby operating the backpressure system to maintain the adjusted determined wellbore pressure at the selected or set point value.

One or more arrangements are further disclosed herein to facilitate the above described methods. Other aspects and advantages of one or more embodiments of the disclosure will be apparent from the following description and the appended claims.

BRIEF DESCRIPTION OF THE DRAWINGS

FIG. 1 shows pressure sensors and an elevation sensor disposed within or about a fluid discharge line.

FIG. 2*a* shows a telescoping joint/variable length portion of a heave motion compensation system in an extended position with elevation change measurement between a fluid discharge line and a pressure sensor.

FIG. 2*b* shows the same telescoping joint/variable length portion in the compressed or collapsed position with elevation change measurement between the fluid discharge line and the pressure sensor.

FIG. 3*a* shows a telescoping joint/variable length portion of a heave motion compensation system in an extended position wherein the elevation/height of the pressure sensor is continuously measured with respect to any change in elevation.

FIG. 3*b* shows a telescoping joint/variable length portion of a heave motion compensation system in the compressed position wherein the elevation/height of the pressure sensor is continuously measured with respect to any change in elevation.

FIG. 4*a* shows a telescoping joint/variable length portion of a heave motion compensation system in an extended position, wherein a flow meter is included in the fluid discharge line.

FIG. 4*b* shows a view of the components in FIG. 4*a*, wherein the telescoping joint/variable length portion is in the compressed position.

FIG. 5*a* shows an arrangement, similar to the one shown in FIG. 2*a*, in which the telescoping joint/variable length portion is in the extended position and the arrangement includes a pit level monitor.

FIG. 5*b* shows the arrangement of FIG. 5*a*, wherein the telescoping joint/variable length portion is in the compressed position.

DETAILED DESCRIPTION

A floating drilling platform, which includes heave motion compensation equipment, is more fully described in U.S. Pat. No. 5,894,895 issued to Welsh, incorporated herein by reference. Such floating drilling platform, drilling unit and heave motion compensation may be used in conjunction with a managed pressure control drilling system, which includes a rotating control head or rotating diverter (RCD), variable fluid discharge control device and various pressure, flow rate and volume sensors, as more fully described in U.S. Pat. No. 6,904,981 issued to van Riet and incorporated herein by reference. In one or more embodiments, the rotating control head may be omitted. In still other embodiments, the system shown in the van Riet patent may be omitted, and drilling conducted without using managed pressure drilling techniques/methods.

Figure 6:
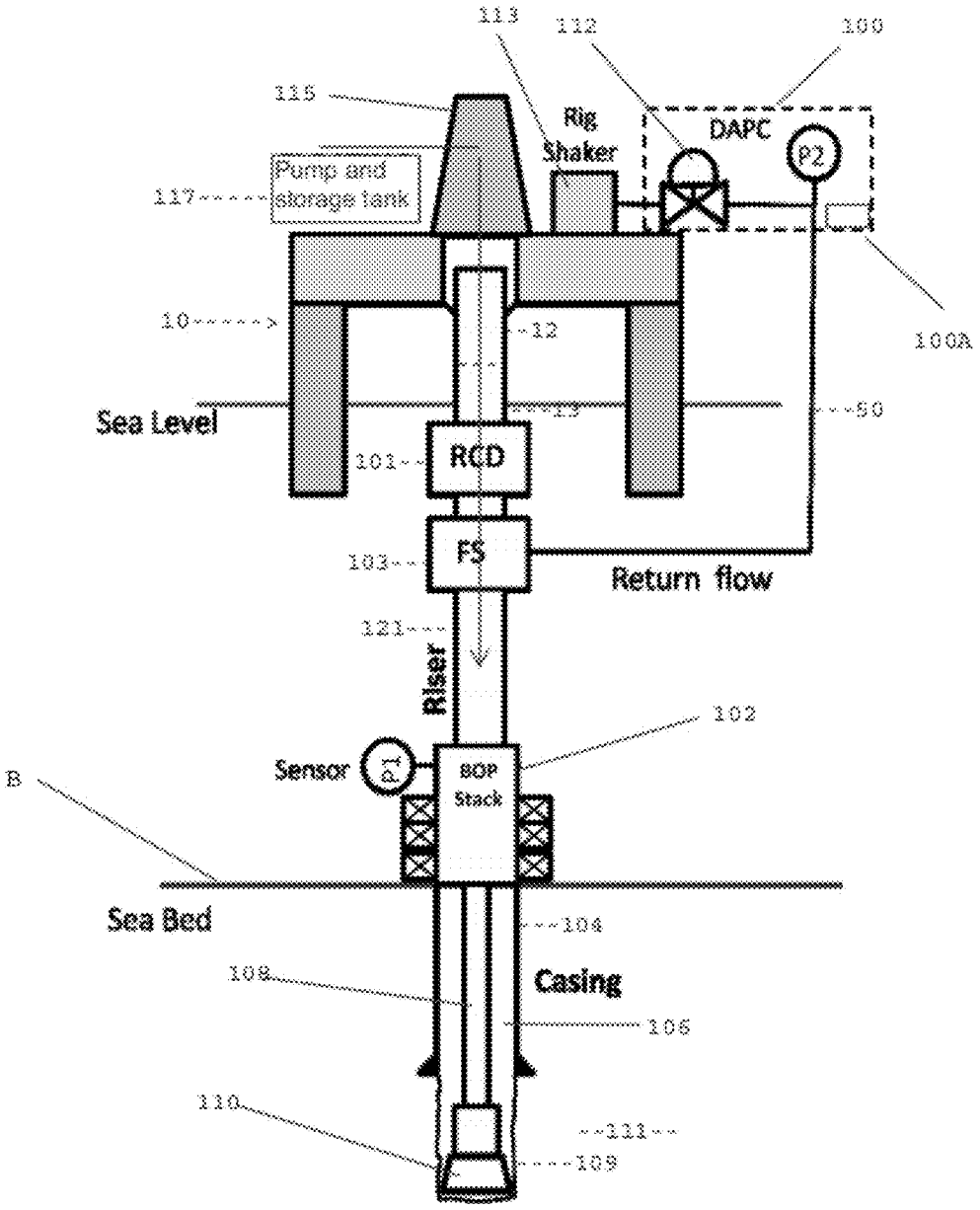
FIG. 6 shows an implementation of arrangement that uses a DAPC system.

An example implementation of a fluid circulation system is shown in FIG. 6. A floating drilling platform 10 may include a rig 115 or similar lifting device to rotatably support/suspend a drill string 108 that is used to drill a wellbore 104 through one or more formations 111 below the bottom of a body of water. Drilling fluid may be pumped from a tank 117 into an interior passageway through the drill sting 108, as shown by the arrows in FIG. 6. The drilling fluid flows through the drill string 108 at a selected rate, whereupon it discharges through a drill bit 110 at the bottom of the drill string 108. The drilling fluid then enters an annular space 106 between the wellbore 104 and the drill string 108. The drilling fluid flow upwardly through the annular space 106, through a set of remotely operable wellbore closure elements, e.g., a blowout preventer (BOP) 102, disposed at the top of a casing disposed in the wellbore 104.

The drilling fluid may enter a riser 121, which is a conduit extending from the BOP 102 to the platform 10. In the example shown in FIG. 6, a flow diverter or "flow spool" 103 may be inserted in the riser 121 at a selected depth below the platform 10. A rotating control diverter 101 may be used to seal the riser 121 for diverting flow through the flow spool 103 into a return line 50. The return line 50 may be coupled to a controllable variable orifice choke 112. After leaving the choke 112, the fluid may be dispensed on to a "shaker" 113 or other equipment to clean the returned fluid of drill cuttings, gas and other contaminants, whereupon it is returned to the tank 117 for reuse. The choke 112 may be controlled by a DAPC system 100, substantially as explained in the van Riet patent referenced above. The DAPC system 100 may include a processor 100A, such as a programmable logic controller (PLC), to accept as input signals, e.g., pressure in the fluid discharge line (including return line 50) and/or flow rate of fluid pumped into the drill string 108 (which may be calculated by measuring an operating rate of the pump in the tank 117), and uses a hydraulics model and mud rheological properties to generate a control signal to operate the choke 112. A variable length joint, e.g., a telescoping joint, which includes a movable portion 12 and optionally, a fixed portion 13, may be disposed at a convenient axial position along the riser 121.

In the detailed descriptions of the FIGS. 1 through 5*b* which follow, the equipment described in the foregoing two referenced patents and as explained with reference to FIG. 6 may be assumed to be included. Such equipment and methods include selectively pumping drilling fluid into a drill string, determining a rate of pumping the fluid into the drill string and measuring fluid pressure proximate a fluid discharge line from the wellbore annulus. Such equipment and methods are also directed to maintaining pressure in the wellbore annulus by using the pumping rate, measured pressure, a hydraulics model of the drill string and wellbore (including rheological properties of the drilling fluid) and by controlling a backpressure system in the fluid discharge line. Such backpressure system may include the variable orifice flow restriction (e.g., a controllable orifice choke as shown in FIG. 6), a back pressure pump coupled to the wellbore annulus or both. The fluid pressure in the wellbore annulus at any axial position therealong may be controlled, not only by operating the controllable orifice and the backpressure system, but also by controlling the rate at which fluid is pumped into the wellbore through the drill string. The pressure may be maintained at a selected value at any selected depth in the wellbore; however, it is typical for the selected depth to be proximate the bottom of the wellbore, thus maintaining the "bottom hole pressure" (BHP). The drawings described herein are greatly simplified for purposes of clearly illustrating one or more methods according to the disclosure. In some implementations, the RCD 101, flow spool 103 and separate return line 50 may be omitted. In other implementations, the DAPC system 100 and controllable choke 112 may be omitted. Such implementations are shown in and explained below with reference to FIGS. 1 through 5*b*.

FIG. 1 shows pressure transducers or sensors, PT1, PT2, PT3, disposed at longitudinally spaced apart locations within/on a wellbore fluid return line 14 and used for the purpose of "kick" detection, i.e., entry of fluid into the wellbore from a formation through which the wellbore has been drilled. The heave susceptible part (i.e., the drilling platform) on which a drilling unit (115 in FIG. 6) is positioned is indicated by reference number 10. A telescoping riser 12, 13 (i.e., a variable length portion of the riser), which in addition to a moveable (i.e., elevatable) portion 12 may also include a non-moving portion 13, is used to maintain hydraulic closure of the wellbore annulus notwithstanding heave motion. An elevation sensor A disposed at a position on the moveable portion 12 of telescoping riser 12, 13 may be used at any time to determine the vertical distance (16 in FIG. 2) between a wellbore fluid outlet pressure sensor (PT in FIG. 2*a*) and the wellbore fluid return line/outlet 14. It should be noted that elevation sensor A measures relative elevation change from a fixed point, e.g., PT (FIG. 2); therefore, the change in elevation in the wellbore fluid return line 14 may be easily determined. Depending on the pressure measured by each of the foregoing sensors, PT1, PT2, PT3, the following inferences may be made. A change in measured pressure only between PT1 and PT2 corresponds to a discharged fluid density change, because PT1 and PT2 are at a different elevations as shown in FIG. 1. A change in measured pressure between PT1 and PT2 and between PT2 and PT3 may indicate a change in fluid viscosity or a wellbore pressure control event, such as fluid influx into the wellbore (i.e., a "kick") or loss of drilling fluid into a formation (i.e., "lost circulation"). The observation of a substantially continuous increase or decrease in pressure measured by all three sensors PT1, PT2, PT3 may be expected for a kick or lost circulation, respectively. Viscosity change of the drilling fluid may be indicated by a limited duration shift in the pressure measured by all three sensors, PT1, PT2, PT3.

In FIG. 2*a*, the elevation sensor A is arranged and designed to determine at any time the elevation of the wellbore fluid return line 14 (e.g., the vertical distance 16 between the wellbore fluid return line 14, which changes elevation, and the fixed elevation wellbore fluid outlet pressure sensor PT or another fixed elevation). Preferably, the pressure sensor PT is disposed in a non-moving portion 13 of the telescoping riser 12, 13 or disposed in a fixed elevation member/part of the riser (e.g., 121 in FIG. 6) coupled to the telescoping riser 12, 13, such that its measurement is related only to the wellbore annulus pressure. Changes in elevation may result in changes in the height of the fluid column in the telescoping riser 12 disposed above the pressure sensor PT. Such changes in fluid column height may affect and be reflected as a change in the pressure of the wellbore fluid as determined at the wellbore fluid return line 14. Such change in pressure may be used to more accurately determine an annulus pressure when employing a DAPC system (100 in FIG. 6). In FIG. 2*a*, the movable portion/joint 12 of telescoping riser 12, 13 is extended from the fixed or non-moving portion/part 13. FIG. 2*b* shows the same system, but with the telescoping riser 12, 13 compressed (i.e., movable portion 12 being retracted/compressed).

For purposes of this and other embodiments, the fluid discharge line 18 may be defined as having a "length" that changes corresponding to changes in the elevation of the floating platform 10 above the water bottom, such elevation changes being enabled by the telescoping riser/joint 12, 13. Such fluid discharge line 18 would include at least the wellbore fluid return line 14 and the moveable (i.e., elevatable) portion 12 of the telescoping riser 12, 13. While the variable length portion of the fluid discharge line 18 (which permits the fluid discharge line 18 to be elevatable) has been associated with a moveable or elevatable portion of a telescoping riser, those skilled in the art will readily recognize that other devices/mechanisms may be equally employed to extend the length or elevate the fluid discharge line 18 to correspond to a change in elevation of the drilling platform above the bottom of a body of water, e.g., due to wave and/or tide action. Further still, the variable length portion of the fluid discharge line 18 may simply be a portion of the riser or return line that is stretched beyond its normal state.

FIGS. 3*a* and 3*b* show an alternative configuration in which the wellbore fluid outlet pressure and the elevation of the movable portion 12 of the telescoping riser 12, 13 are measured at the same elevation. The change in length of the moveable portion/joint 12 of telescoping riser 12, 13 may be used to correct the pressure measurements made by the pressure sensor PT to account for the change in the height of the fluid column resulting from extension and compression of the telescoping joint 12, 13. Furthermore, the changes in pressure as measured by pressure sensor PT may be compared to the pressure changes relating to changes in fluid column height to determine whether a wellbore control event, e.g., a kick or fluid loss, has occurred. For example, a change in measured wellbore fluid outlet pressure that is greater than the change in fluid column height (as determined via elevation sensor A) would be indicative of a fluid kick.

Similar principles may be used to correct measurements made by a flowmeter disposed in the wellbore fluid return line 14. Referring to FIG. 4*a*, a flowmeter FM is disposed in the fluid return line 14 and measures rate of fluid flow therethrough. The fluid return line 14 may terminate in a tank or pit 20. If the flowrate of fluid pumped into the wellbore is the same, or substantially the same, as the flowrate of fluid flow out of the wellbore, then pressure measurements made by the pressure transducer PT disposed within the fixed portion/part 13 of the telescoping riser 12, 13 may be used to calculate changes in the system volume between the fixed portion/part 13 and the fluid return line 14. Changes in pressure measurement relate to changes in system volume by reason of change in length of the telescoping riser 12, 13, as measured by the pressure transducer PT and/or elevation sensor A. Changes in the system volume of this portion of the drilling fluid circulating system (i.e., the moveable portion 12 of the telescoping riser 12, 13) will affect the flow rate measured by the flowmeter FM. The calculated changes in system volume may be used to correct the measurements made by the flowmeter FM. FIG. 4*b* shows the telescoping riser 12, 13 in the compressed position. Inclusion of a flowmeter FM as shown in FIGS. 4*a* and 4*b* may be in addition to the pressure sensor implementations shown and described with reference to FIGS. 1*a* through 3*b*.

In still another implementation, and referring to FIG. 5*a*, a pit level indicator LM may be included in the tank or pit 20 to monitor any changes in liquid level therein. Changes in liquid level may be used, for example, as indication of lost circulation into a subsurface formation, or entry into the wellbore of fluid from a subsurface formation, e.g., a kick. It will be appreciated that the measurements made by the level indicator LM may be affected by the rate at which fluid leaves the fluid return line 14. As with the other examples explained herein, such rate may be affected by changes in the system volume resulting from extension or compression of the telescoping riser 12, 13 as a result of heave motion of the platform 10. Measurements from the pressure transducer PT mounted on the fixed portion 13 of telescoping riser 12, 13 or on a non-moving (i.e., fixed elevation) member/part (e.g., riser 121 in FIG. 6) coupled to the telescoping riser 12, 13 may be used to determine changes in system volume, and thus correct the measurements made by the pit level indicator LM. FIG. 5*b* shows the system of FIG. 5*a* with the telescoping riser 12, 13 compressed.

FIG. 6 shows another implementation, as previously explained, in which a DAPC system may be used. The DAPC 100 system may be substantially as explained in the van Riet patent described herein above. One or more pressure sensors P1 may be positioned to measure wellbore annulus pressure at a position as close as possible to the outlet end portion of the BOP 102 ("near-BOP pressure sensor") or proximate the bottom of the body of water (as shown at B). One or more additional pressure sensors P2 may be positioned near, and just upstream of the choke 112. The RCD 101 may be included in the drilling riser 121 to create a closed-system for drilling, while a flow spool (FS) 103 may be used to divert the drilling fluid from the annulus 106 to the return flow line 50.

One or more of the present embodiments use the near-BOP pressure sensor P1 to measure fluid pressure in the annulus 106 proximate BOP 102. The pressure measured may also have its first time derivative determined (i.e., change in pressure versus change in time) and such derivative may be provided as signal input to the DAPC system 100. The one or more other pressure sensors P2 may be used, as substantially explained above, to monitor pressures proximate the wellbore fluid return line 50, preferably upstream of the variable orifice choke 112, and/or the first time pressure derivative may be determined. As further disclosed hereinafter, the pressures needed to compensate for heave of the platform and motion of the drill string may be input to the DAPC system 100 by comparing the first derivatives of the measured pressures at P1 and P2.

Figure 7:
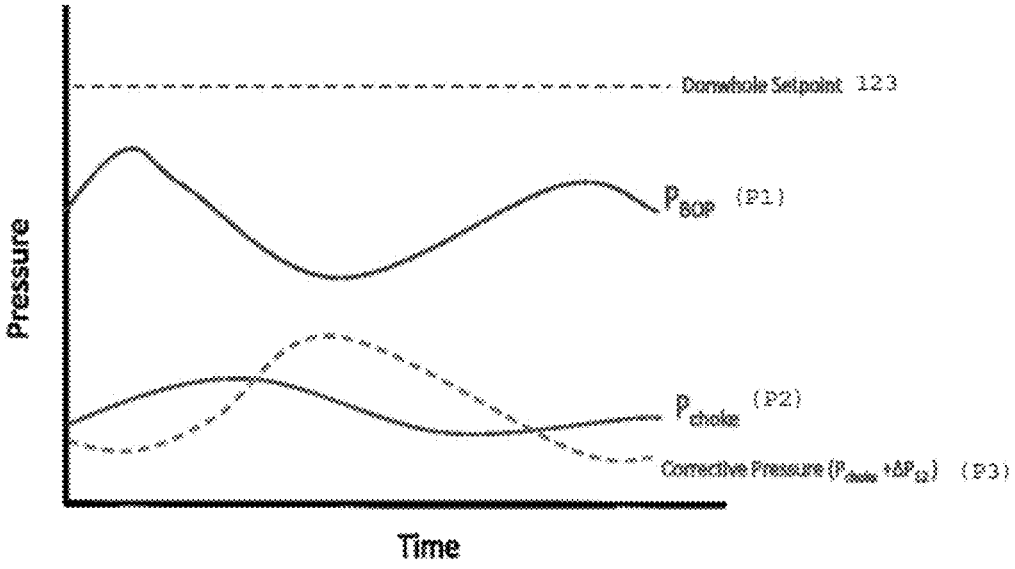
FIG. 7 is a graphical representation of pressure change, as measured by the pressure sensors shown in FIG. 6, versus time. The calculated control/back pressure needed to dampen the pressure change versus time, e.g., via a choke in the DAPC system of FIG. 6, is also represented.

As will be understood from FIG. 7, the DAPC system (100 in FIG. 6), through use of the time derivatives of the pressure measurements at P1 and P2, causes the variable orifice choke (112 in FIG. 6) to dynamically apply the necessary corrective pressures, as shown at P3. Such corrective control/back pressures compensate for the motion of drilling platform and drill string in real-time, while taking into consideration the desired downhole pressure set point, as shown at 123. In one example embodiment, a signal input to the DAPC system (100 in FIG. 6) may include a difference between the first derivatives of the pressures measured at P1 and P2. Using one or more of the embodiments disclosed herein, the bottom hole pressure may be advantageously and accurately managed in deep water applications, e.g., greater than 5,000 feet (8,000 meters).

While the invention has been described with respect to a limited number of embodiments, those skilled in the art, having benefit of this disclosure, will appreciate that other embodiments can be devised which do not depart from the scope of the invention as disclosed herein.

What is claimed is:

1. A method comprising the steps of:

pumping fluid at a determined flow rate into a drill string disposed in a wellbore; the drill string being suspended from a drilling platform floating on a body of water and having a drill bit disposed on a distal end thereof;

measuring fluid pressure of fluid returning from the wellbore within an elevatable portion of a fluid discharge line in at least two longitudinally spaced-apart positions at substantially a same elevation above a bottom of the body of water, the fluid discharge line having a variable length portion arranged and designed to vary the length of the fluid discharge line to correspond to a change in elevation of the drilling platform above the bottom of the body of water;

determining at least one of a change in fluid viscosity, an entry of fluid into the wellbore from a subsurface formation or a loss of pumped fluid into the subsurface formation based on differences between the measured fluid pressure at the spaced-apart positions;

determining a wellbore pressure at a position selected from the group consisting of a selected depth position in the wellbore, a position along a drilling riser and a position along the variable length portion of the fluid discharge line, the wellbore pressure being determined using at least one of the determined flow rate, the measured fluid pressure, a hydraulics model or rheological properties of the fluid; and adjusting the determined wellbore pressure to account for changes in length of the fluid discharge line corresponding to changes in elevation of the drilling platform above the bottom of the body of water.

2. The method of claim 1 wherein, the step of adjusting the determined wellbore pressure comprises the steps of determining a change in length of the fluid discharge line and calculating a change in hydrostatic pressure of fluid in the fluid discharge line caused by the change in the length of the fluid discharge line.

3. The method of claim 2 wherein, the step of determining the change in length of the fluid discharge line is conducted using an elevation sensor disposed on the variable length portion of the fluid discharge line.

4. The method of claim 1, further comprising the step of, operating a backpressure system to maintain the adjusted determined wellbore pressure at a selected value.

5. The method of claim 4 wherein, the step of operating the backpressure system comprises the steps of measuring a fluid pressure in the wellbore proximate a blowout preventer and measuring a fluid pressure in the fluid discharge line at a position prior to a controllable orifice choke disposed therein.

6. The method of claim 5 further comprising the step of, determining time derivatives of the measured fluid pressure in the wellbore proximate the blowout preventer and the measured fluid pressure in the fluid discharge line at the position prior to the controllable orifice choke disposed therein.

7. The method of claim 6 further comprising the step of, operating the choke to maintain adjusted well bore pressure at a selected value, the choke operation being guided at least by the determined time derivatives.

8. The method of claim 1 further comprising the steps of, measuring fluid pressure in the elevatable portion of the fluid discharge line at a third position at a different elevation than the at least two longitudinally spaced-apart positions, and determining a change in fluid density of fluid being discharged from the wellbore based upon the measured fluid pressure from the third location and the measured fluid pressure from at least one of the at least two longitudinally spaced-apart positions.

9. The method of claim 1 further comprising the steps of, measuring fluid flow rate through the fluid discharge line, and adjusting the measured fluid flow rate for changes in volume resulting from changes in the length of the fluid discharge line.

10. The method of claim 1 further comprising the steps of, measuring a fluid level in a tank receiving fluid from the wellbore, and adjusting the measured fluid level for changes in volume resulting from changes in the length of the fluid discharge line.

11. A method comprising the steps of:

pumping fluid through a drill string extended from a drilling platform into a wellbore drilled through a subsurface formation; measuring a flow rate of the pumped fluid;

measuring a first fluid pressure in an annular space between the drill string and a wall of the wellbore at a position proximate a bottom of a body of water on which the drilling platform floats; measuring a second fluid pressure proximate a variable orifice flow restriction disposed in a fluid outlet from the annular space, the annular space arranged and designed to change length as a result of heave of the floating drilling platform;

determining time derivatives of the first and second fluid pressures; and controlling the variable orifice flow restriction to maintain a selected pressure in the wellbore based upon at least the time derivatives of the first and second pressures.

12. The method of claim 1, further comprising measuring a relative elevation change of the variable length portion.

13. A method comprising the steps of:

pumping fluid at a determined flow rate into a drill string disposed in a wellbore, the drill string being suspended from a drilling platform floating on a body of water;

measuring fluid pressure of fluid returning from the wellbore within a fluid discharge line, the fluid discharge line having a variable length portion arranged and designed to vary the length of the fluid discharge line to correspond to a change in elevation of the drilling platform above a bottom of the body of water;

determining a wellbore pressure at a position selected from the group consisting of a selected depth position in the wellbore, a position along a drilling riser, and a position along the variable length portion of the fluid discharge line, the wellbore pressure being determined using at least one of the determined flow rate, the measured fluid pressure, a hydraulics model or rheological properties of the fluid;

operating a backpressure system to maintain the adjusted determined wellbore pressure at a selected value by measuring a fluid pressure in the wellbore proximate a blowout preventer and measuring a fluid pressure in the fluid discharge line at a position prior to a controllable orifice choke disposed therein; and adjusting the determined wellbore pressure to account for changes in length of the fluid discharge line corresponding to changes in elevation of the drilling platform above the bottom of the body of water.

14. The method of claim 11, wherein controlling the variable orifice flow restriction compensates for motion of the drilling platform in real time.

15. The method of claim 12, further comprising determining a vertical distance between a fixed portion and the variable length portion of the fluid discharge line.

16. The method of claim 12, further comprising measuring a wellbore fluid outlet pressure and an elevation of the variable length portion of the fluid discharge line at a same elevation.

17. The method of claim 12, further comprising monitoring a flowrate of fluid from a fluid return line of the fluid discharge line pumped to a pit.

18. The method of claim 17, further comprising monitoring a level of fluid in the pit.

19. The method of claim 17, further comprising calculating changes in a volume of the fluid discharge line and comparing the changes in the volume to the flowrate of fluid pumped to the pit.

* * * * *